US005147423A

United States Patent [19]

Richards

[11] Patent Number: 5,147,423

[45] Date of Patent: Sep. 15, 1992

[54] CORONA ELECTRODE FOR ELECTRICALLY CHARGING AEROSOL PARTICLES

[76] Inventor: Clyde N. Richards, P.O. Box 216, Peralta, N. Mex. 87042

[21] Appl. No.: 663,320

[22] Filed: Mar. 1, 1991

[51] Int. Cl.[5] ..... B03C 3/36

[52] U.S. Cl. ..... 55/129; 55/138; 55/146

[58] Field of Search ..... 55/129, 146, 138, 134, 55/135, 128

[56] References Cited

U.S. PATENT DOCUMENTS

| | | | |
|---|---|---|---|
| 3,315,444 | 4/1967 | De Seversky | 55/129 X |
| 3,511,030 | 5/1970 | Hall et al. | 55/129 |
| 3,668,835 | 6/1972 | Vicard | 55/129 X |
| 3,755,611 | 8/1973 | Quek et al. | 55/146 X |
| 3,768,258 | 10/1973 | Smith et al. | 55/146 X |
| 3,907,520 | 9/1975 | Huang et al. | 55/129 X |
| 4,077,783 | 3/1978 | Honacker | 55/146 |
| 4,202,674 | 5/1980 | Rodenberger et al. | 55/129 X |
| 4,230,466 | 10/1980 | Michel | 55/147 |
| 4,251,234 | 2/1981 | Chang | 55/129 X |
| 4,294,591 | 10/1981 | Kahl | 55/120 |
| 4,900,527 | 2/1990 | Lierke | 55/123 X |
| 5,006,134 | 4/1991 | Knoll et al. | 55/146 |

FOREIGN PATENT DOCUMENTS 460072 5/1928 Fed. Rep. of Germany ..... 55/146

*Primary Examiner*—Richard L. Chiesa
*Attorney, Agent, or Firm*—Robert W. Harris

[57] ABSTRACT

Electrode apparatus for increasing the charge state of aerosol particulates entrained in a flowing gas, such as smoke particles in effluent emitted from a power plant, so as to improve the collection efficiency of conventional electrostatic precipitation apparatus. A corona-generating high voltage electrode is located immediately downstream in the gas flow from a region of mechanically constricted high velocity gas flow, and generates molecular gas ions, some of which attach to and charge aerosol particulates near the corona-generating electrode, and the remainder of which are swept up by the gas as they attempt to move upstream from the electrode into a region of rapidly decreasing field strength and increasing gas flow velocity. Moving downstream from the corona-generating electrode, the molecular ions contribute to further charging of the aerosol particulates through space charge effects, including field effect and diffusion charging. The apparatus includes an improved main electrode support, offering superior means to maintain the corona-generating electrode in a mechanically and electrically stable configuration.

15 Claims, 2 Drawing Sheets

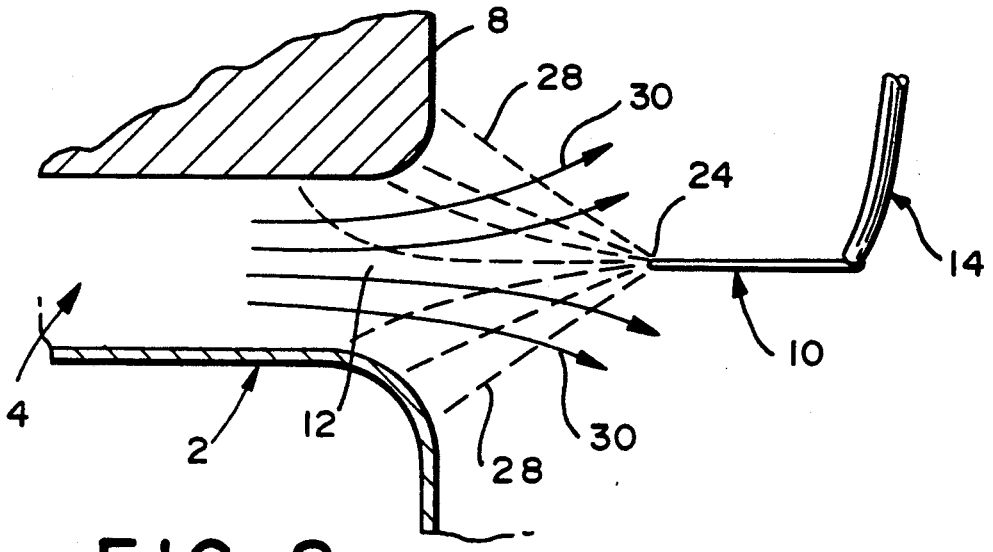
FIG. 2
FIG. 3
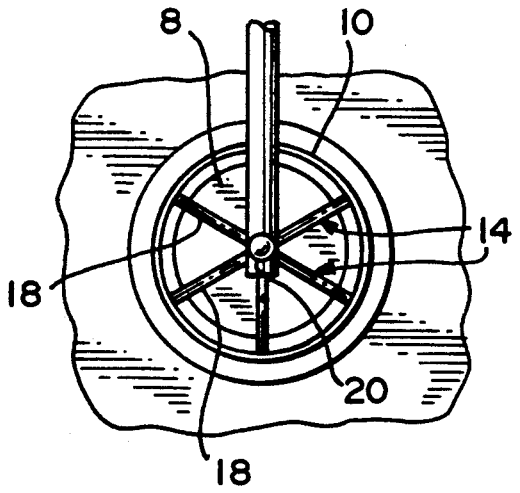
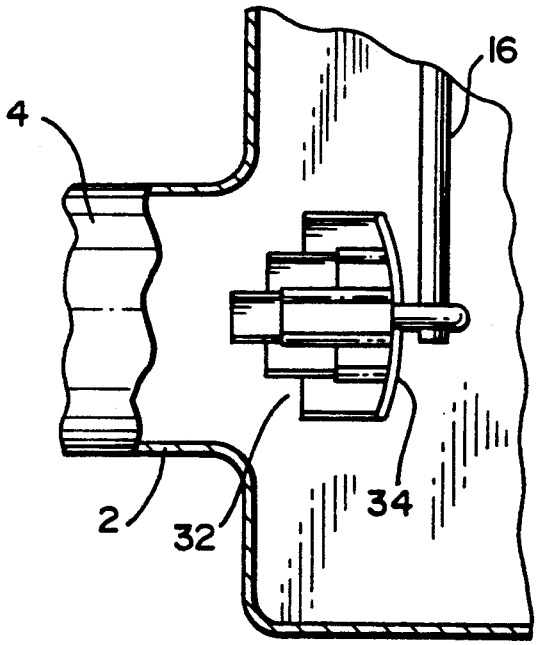
FIG. 4

CORONA ELECTRODE FOR ELECTRICALLY CHARGING AEROSOL PARTICLES

BACKGROUND OF THE INVENTION

Applicant's invention primarily concerns electrostatic precipitating machines designed for removal of liquid or solid particles of a pollutant found in a flowing gas, such as, for example, particles of smoke found in the gases produced in burning of fossil fuels at a power plant, dusts created during grinding and pulverizing processes, and mists created during the operation of various kinds of chemical processes. Although the primary applications of the invention have to do with control of air pollution, there may as well be other applications of the present invention, in which machines employing electric fields are used to affect the motion of charged particulates flowing in a gas.

Applicant's invention does not itself deal primarily with electrostatic removal of aerosol particulates found in a flowing gas, which is the subject of numerous prior art devices. It is well known in the art that such particles, if electrically charged, may be removed by the application of an electrostatic field directed in a direction generally perpendicular to the gas flow direction, so that the particles may be swept up and collected upon the electrodes used to set up the electric field. For example, the gas may be made to flow between parallel plates across which an electrostatic potential difference is applied, creating an electric field normal to the plates and to the direction of the gas flow. Or the gas may be caused to flow down a cylindrical guide having metal walls and a wire electrode along the axis of the cylinder, and exposed to a radially directed electric field, produced by application of a electrostatic potential difference between the axial electrode and the cylinder wall.

Obviously the efficiency of such electrostatic precipitation machines will be strongly dependent upon the charge state of the particles to be removed. If any significant percentage of these particles remain uncharged while transiting the region of the sweeping electric field, these will escape removal and results will be unsatisfactory, no matter how well designed are the sweeping electrode apparatus and associated components. And for those particles which are charged during transit of the sweeping field region, the sweeping field will obviously be more effective, the greater the average number of charges carried by said particles.

The specific area of applicant's invention is that of apparatus intended to optimize the efficiency of conventional electrostatic precipitator apparatus used in sweeping charged particulates out of a flowing gas, by maximizing the charge state of such particulates before they reach the region of the sweeping electrostatic field.

SUMMARY OF THE INVENTION

Applicant's invention involves two combinations of components which are useful in electrostatic precipitating machines, for the purpose of enhancing the removal of aerosol pollutants entrained in a flowing gas, by facilitating the maximum charging of such aerosol particulates, as an aid to the functioning of conventional electrostatic precipitation devices which may be placed within the machine, downstream in the gas flow from the location of the present invention, for removal of the aerosol particulates.

One such combination includes an electrode with sharp edges, charged to a high potential producing a corona in the gas and generating molecular ions which are repelled by the band electrode toward the walls of the device, and a surrounding electric field and gas flow geometry which together act to promote maximum charging of the aerosol particles, so as to facilitate removal of said particles by electrostatic precipitator means located downstream from the band electrode. In the preferred embodiment this sharped-edged electrode is a band electrode, bent into a circular configuration, mounted on a spider electrode to a main electrode support which conveys a high potential to the band electrode. The band electrode is located a short distance downstream from a region in which the gas flow has been mechanically constricted so as to produce a higher gas flow velocity than exists outside of said region. The electric field configuration surrounding the band electrode is such that the field lines rapidly diverge, with resulting rapid decrease of field strength, as the molecular ions on the upstream side of the band electrode move upstream toward the walls of the device, under the action of the electric field. These molecular ions, moving into the edge of the high velocity constricted flow region, encounter greatly increased gas flow velocity just as they experience greatly reduced electric field strength. As a result, those molecular ions which do not attach to and charge aerosol particles near the edge of the band electrode, do not reach the walls of the device, but are instead swept past the band electrode, on diverging lines of gas flow exiting the constricted flow region, and enter a region of greatly reduced gas flow velocity. In this region the entrained molecular ions, together with those aerosol particles which have already acquired charges, create a significant space charge, which contributes to further charging of the aerosol particles, through both field charging and diffusion charging effects.

Applicant's invention also involves an advantageous auxiliary combination which deals effectively with the problem of maintaining the band electrode supported in the gas flow stream in a mechanically stable configuration and at a stable high potential, either constant or pulsed, without the electrostatic breakdown which often occurs on insulator surfaces exposed to pollutants, particularly in pollution control machines which employ water droplets for various purposes, such as gas scrubbing, in which machines there is a tendency for all surfaces to accumulate a water film. This combination of elements for the main electrode support, from which the band electrode is supported by a spider electrode, includes two conventional cone-shaped ceramic high voltage insulators, one inside and one outside the chamber of the machine, which are compression clamped in an opposing configuration holding the main electrode support securely to a flange in the side of the gas flow chamber, and which convey the main electrode support through the wall of the machine for connection to a source of high voltage; a heater coil between the cone-shaped electrodes, which maintain the insulators at a temperature above the dew points of the gases to which they are exposed, to prevent moisture condensation on the insulator surfaces; a charged corona generating disc mounted on the main electrode support near the interior cone-shaped insulator, which charges those aerosol particles in the gas which move toward said insulator, and two or more coaxial cone-shaped, open-ended metal insulator shields surrounding the interior cone-shaped insulator, which are charged to different potentials, and thus have an electric field between them which acts to sweep up aerosol particles moving toward the interior insulator.

The principal purpose of the present invention is to provide a simple, easily manufactured and inexpensive apparatus which may be used to maximize the average charge state of aerosol particulates flowing in a gas within a chamber, and which may thereby be used, among other things, to improve the efficiency of electrostatic precipitators used to reduce air pollution caused, for example, by emission of smoke particles from power plants.

It is another purpose of the present invention to provide such an apparatus involving a mechanically and electrically stable electrode support structure, of a form which may also be used for other applications in which high voltage electrodes must be supported within a chamber containing aerosol particulates and possibly exposed to water droplets and/or contaminant particulates which tend to produce high voltage flashovers across insulator surfaces.

BRIEF DESCRIPTION OF THE DRAWINGS

FIG. 2 is an enlarged view of a small portion of the section shown in FIG. 1, showing the configuration of electric field lines (dotted lines) and lines of gas flow (solid lines) between the lower edge of the band electrode, the chamber wall, and the insert used to constrict gas flow in the region to the left of the band electrode.

FIG. 3 is a view from downstream of the band electrode (from the right side in FIG. 1), looking upstream along the axis of the band electrode, which is the same axis as the axes of the cylindrical gas flow tube and insert shown on the left side of FIG. 1.

FIG. 4 is a side elevational section as in FIG. 1, for an alternative form of the invention, employing multiple band electrodes, and omitting the gas tube insert shown in FIG. 1.

DESCRIPTION OF THE PREFERRED EMBODIMENTS

Figure 1:
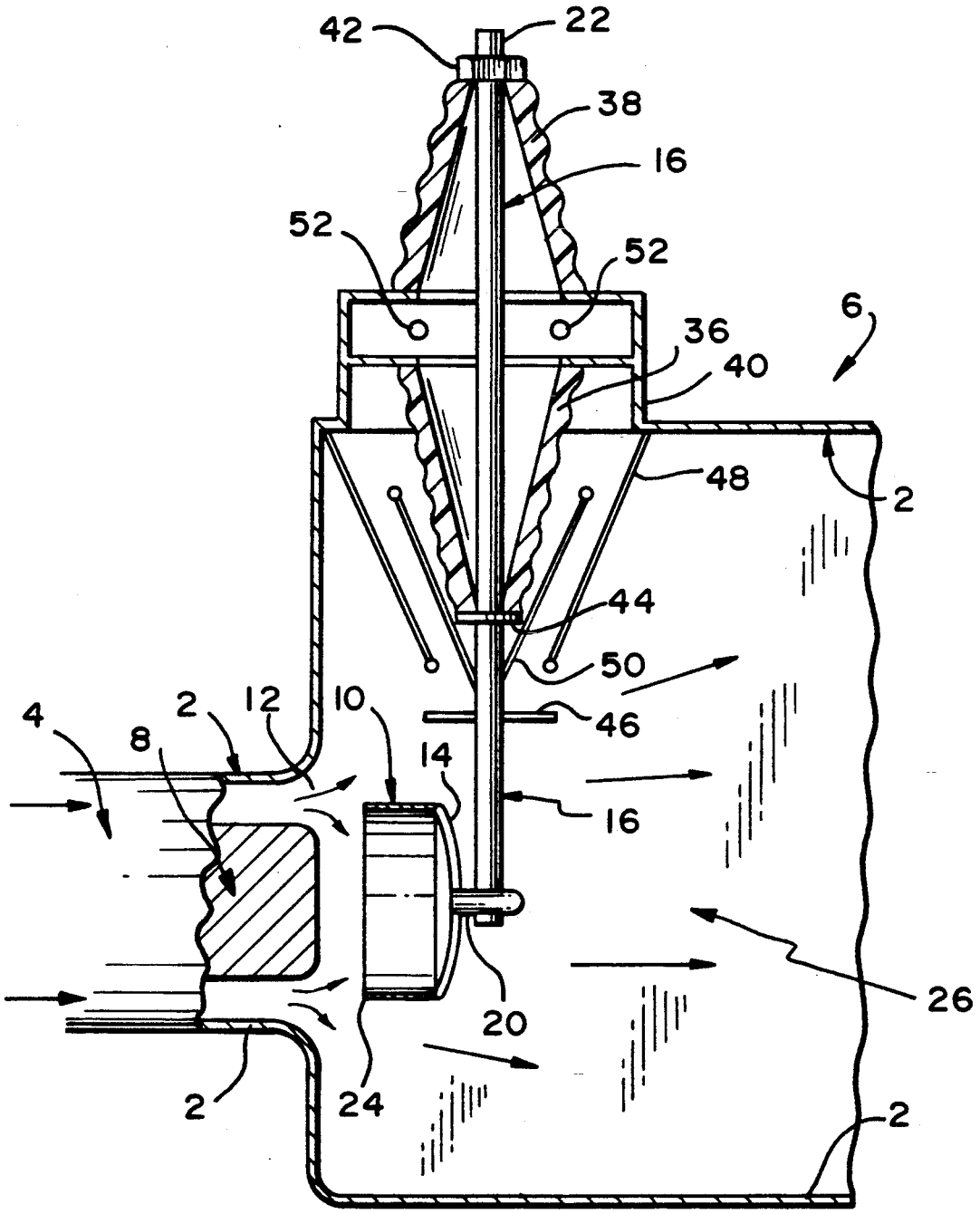
FIG. 1 is a side elevational section of an electrostatic precipitator apparatus' gas flow geometry showing the preferred embodiment configuration of the present invention, just outside a region in which the gas flow has been artificially constricted to produce a region of high gas velocity. The conventional electrostatic precipitator electrodes, which would be located downstream of the present invention (to the right in the figure) are omitted for simplicity.

Referring now to the drawings, in which like reference numbers denote like of corresponding parts, the configuration of one embodiment of the invention is shown in FIGS. 1-3. In FIG. 1 there is seen in section a portion of an apparatus employing the present invention, in which the wall 2 of the apparatus has two portions relevant to the functioning of the invention: a cylindrical duct 4, in which gas flows from the left, having been put in motion by blowers, fans or other convenient means, and a cylindrical chamber 6 of much larger cross section than that of duct 4. Gas containing solid or liquid particulates to be removed by electrostatic precipitation flows into chamber 6, through duct 4. The electrostatic precipitation electrodes and associated components for removal of the particulate matter will be located to the right of the present invention in FIG. 1, and are omitted for simplicity, since the details of their structure have no bearing upon the present invention. It is merely assumed, for purposes of this description, that to the right of the structure of the invention shown in FIG. 1, is an apparatus for electrostatic precipitation of the particulate matter contained within the flowing gas, in which a high electrostatic potential will be applied across electrodes oriented in a direction essentially parallel to the direction of the gas flow, so that the resulting electric field is essentially perpendicular to the gas flow direction. As already noted, such an apparatus may consist, for example, of parallel plate electrodes, with the gas flowing between the plates in a direction parallel to the surfaces of the plate electrodes. The only relevance of the electrostatic precipitation apparatus, for purposes of the description of the present invention, is that it is an apparatus, downstream in the gas flow from the present invention, which removes the aerosol particulates with an efficiency which may be optimized by maximizing the charge state of the particles to be removed.

The cylindrical duct 4 contains a solid concentric cylindrical duct insert 8, so that the gas flow in duct 4, immediately before entry of the gas into chamber 6, is significantly constricted, with the gas flowing in duct 4 in a space of annular cross section, between duct insert 8 and wall 2, which annular region has a cross sectional area much smaller than the interior cross sectional area of duct 4, and many times smaller than the interior cross sectional area of chamber 6. As a result, in a steady state of gas flow, the gas flow velocity within duct 4 is many times higher than the gas flow velocity existing in chamber 6 away from the outlet of duct 4.

The invention employs a band electrode 10, having a sharp edge adapted to creation of a corona discharge, which electrode is bent into a closed circle, as best shown in FIGS. 1 and 3, thus forming a short cylindrical section, oriented with the axis of said cylindrical section being at least substantially coaxial with the common cylindrical axis of duct 4 and duct insert 8, with the sharp edge of band electrode 10 facing the outlet 12 of duct 4. The band electrode 10 is attached by a spider support 14 formed of electrically conductive material to a main electrode support 16, with main electrode support 16 being oriented perpendicularly to the axis of chamber 6 and passing through the wall 2 of chamber 6, with main electrode support 16 also being formed of electrically conductive material. Main electrode support 16 is maintained in a mechanically and electrically stable insulated manner by means described below. Spider support 14 is formed of legs 18 of a conductive material, radiating outward from a hub 20 of conductive material attached to main electrode support 16. Each of legs 18 has a curvature in a direction perpendicular to main electrode support 16 and in the direction of duct insert 8 and outlet 12 of duct 4, so that band electrode 10 is supported away from main electrode support 16, in the direction of duct insert 8 and outlet 12 of duct 4.

The duct insert 8 acts not only to produce much higher gas flow velocity within duct 4 than that existing in chamber 6, but, more importantly, also concentrates gas flow in the direction of band electrode 10.

To operate the present invention, a high DC voltage of the order of 50,000 volts is applied to the main electrode support 16 at the external end 22 of main electrode support 16, using any convenient high voltage DC power supply. The high voltage applied to main electrode support 16 is communicated to band electrode 10 via spider support 14. Such a voltage is sufficient to cause ionization of the gas at the edge 24 of band electrode 10, and a corona discharge near edge 24, but is not sufficient to cause a complete breakdown of the gas between edge 24 and wall 2.

The corona produces molecular ions in the gas near edge 24, having a polarity determined by the polarity of the potential applied at external end 22 of main electrode support 16. Either polarity may be used for said potential. These molecular ions, having a polarity which is the same as that of band electrode 10, are repelled from band electrode 10 by the electric field surrounding band electrode 10, which tends to move the molecular ions towards wall 2, outlet 12 of duct 4, and duct insert 8.

The molecular ions have a mobility of the order of 2 centimeters per second per volt per centimeter. The system is operated with an electric field of the order of 10 kilovolts per centimeter in the region near edge 24 of band electrode 10, so that the corresponding drift velocity of the molecular ions near edge 24 is of the order of 200 meters per second, which is much faster than the gas flow velocity for systems of interest. Thus many or most of the molecular ions would quickly reach wall 2 or duct insert 8, moving against the flow of the gas, were it not for two additional processes which come into play:

First, some of the molecular ions attach to aerosol particulates, before they can reach wall 2 or duct insert 8. These aerosol particles so charged have a much smaller mobility than the gaseous molecular ions, and are effectively frozen in the flow field of the aerosol, so that they are entrained in the gas and continue to move downstream as the gas moves downstream away from outlet 12 of duct 4, into region 26 in the open portion of chamber 6, downstream of band electrode 10. Thus none of the molecular ions which attach to aerosol particulates reach wall 2 or duct insert 8.

Second, for those of the molecular ions which do not attach to aerosol particulates, two phenomena inherent in the geometry of the invention act to also prevent these molecular ions from reaching wall 2 or duct insert 8, and to cause these molecular ions also to move downstream past band electrode 10 into the open region 26 of chamber 6. As best seen in FIG. 2, as the molecular ions move away from edge 24 of band electrode 10 toward wall 2, outlet 12 of duct 4, and duct insert 8, the electric field lines 28 diverge very rapidly, so that the electric field strength acting upon these ions very rapidly diminishes. Just as the molecular ions experience a rapidly diminishing electric field strength while moving away from band electrode 10 in the direction of wall 2, outlet 12 of duct 4, and duct insert 8, they are bucking gas flow lines 30 which very rapidly converge as the molecular ions approach outlet 12 of duct 4. Moving into the region of outlet 12 of duct 4, the molecular ions therefore experience much higher gas flow velocity, and much greater drag forces tending to make the molecular ions move in the direction of the gas flow. The result of the combined effects of rapidly diminishing electric field strength, and greatly increased gas flow velocity experienced by the molecular ions moving away from band electrode 10, is to cause the flowing gas to sweep up these molecular ions before they can reach wall 2 or duct insert 8, and sweep them downstream on the diverging gas flow lines 30, past band electrode 10, to region 26, the region in which the gas flow velocity is greatly diminished by the greatly increased cross sectional area of chamber 6.

In region 26, a significant space charge is thus built up, both from aerosol particulates which were charged by having picked up molecular ions near band electrode 10, and also from the molecular ions which were swept up and moved downstream by the gas before they could reach wall 2 or duct insert 8. This space charge acts to further increase the charging of aerosol particulates, by two processes.

For aerosol particulates larger than about 2 microns in diameter, the significant charging mechanism is field charging by the unipolar molecular ions in conjunction with the electric field generated by the space charge in region 26. Since the aerosol particulates have a higher dielectric constant than the gas, they distort the electric field lines inward near the particles, causing the unipolar molecular ions to be drawn to the aerosol particulates, giving up their charges to the particles upon collision. The amount of charge which may be acquired by an aerosol particulate particle per unit time is proportional to the square of the particle diameter, for a given electric field strength, and varies linearly with the field strength. So although field charging effects are significant for aerosol particulates larger than about 2 microns, they are not significant for smaller aerosol particulates.

For aerosol particulates smaller than about 0.1 microns in diameter, diffusion charging of the aerosol particulates will be the main charging mechanism in region 26. In the range from about 0.1 microns to about 2 microns, field charging and diffusion charging will complement one another. The diffusion charging process, which does not require the presence of any electric field, results simply from collisions of the molecular ions and aerosol particulates caused by the random "Brownian" motion of the ions and particles. The rate of charging on the aerosol particulates increases with particle size, and the unipolar ion density.

An alternative embodiment of the invention is illustrated in FIG. 4. This embodiment is intended for achieving much higher flow rates than can be achieved with the constricted gas flow produced by use of the duct insert 8 shown in FIGS. 1-3. Thus in the alternative embodiment the duct insert is omitted. There are two disadvantages of this alternate embodiment. The duct insert 8 of the first embodiment served to concentrate the gas flow in the direction of band electrode 10, thus maximizing the interaction of the aerosol particulates with the corona near edge 24 of band electrode 10, and the opportunity for the molecular ions created in the corona to attach to aerosol particulates near the edge 24. In an effort to at least partially overcome this disadvantage of omission of the duct insert, the alternative configuration employs an array of circular band electrodes 32, of varying radii, rather than a single one, which are concentric with one another and with the axis of duct 4, and are supported by a spider support 34 from main electrode support 16, and charged to a high potential in the manner previously described. By using an array of circular band electrodes 32, the entire width of the gas stream exiting duct 4 can be more effectively covered to enhance the opportunity for charging of the aerosol particulates near the edges of the circular band electrodes 32. The various circular band electrodes 32 are staggered, with the electrodes of progressively smaller radii being located progressively closer to duct 4, so as to prevent the larger radius electrodes from electrostatically screening the smaller ones. The physics of the processes occurring in the alternative embodiment is at least qualitatively the same as that of the embodiment shown in FIGS. 1-3.

For both embodiments of the invention, the combination of components shown in the upper portion of FIG. 1 provide a new way to maintain main electrode support 16 in an electrically and mechanically stable configuration for supporting the circular band electrodes and spider electrodes and communicating stable high voltage to them.

Strong and stable mechanical support for main electrode support 16 is afforded by use of opposingly oriented cone-shaped insulators 36 and 38 to securely fasten main electrode support 16 to a flange 40 welded or otherwise securely fastened in the wall of chamber 6, with insulators 36 and 38 being compressed against flange 40 by the compressive action of an exterior nut 42, threadably engaging a threaded portion of main electrode support 16, and an internal stop 44, welded or otherwise securely fastened to main electrode support 16 inside chamber 6 just below the interior insulator 36.

It is of course essential for optimum functioning of the invention to also maintain the electrical insulation integrity of insulators 36 and 38. If the surface of either insulator is allowed to become dirty and wet, a flashover will occur between flange 40 and main electrode support 16, interrupting the supply of high voltage to the corona-generating band electrode 10. It is easier to maintain the surface of exterior insulator 38 in a dry, clean condition, simply by regular cleaning and drying, than to so maintain the surface of interior insulator 36, which is exposed to the aerosol particulates flowing within chamber 6. There will be a tendency for all surfaces within chamber 6 to become wet, if the aerosol particulates are of liquid form, or if other parts of the pollution control apparatus employ any wet scrubbing method for gas cleaning. If the aerosol particulates contain impurities, such as in the case of smoke particles in a power plant effluent, the surface of interior insulator 36 will tend to quickly become both wet and dirty, making flashovers a major problem, unless adequate preventive means are employed.

The present invention combines several mechanisms which work together to maintain the surface of interior insulator 36 in a clean, dry condition. A sharp-edged corona emitting disk 46 is attached to main electrode support 16 a short distance below interior insulator 36. The corona emitting disk 46 tends to charge any aerosol particulates which may move upward past corona emitting disk 46, toward interior insulator 36. In order to prevent such charged aerosol particulates from reaching the surface of interior insulator 36, a pair of coaxial open-ended cone shaped electrically conductive insulator shields 48 and 50 are provided, which are coaxial with main electrode support 16. One insulator shield 50 is securely fastened to main electrode support 16 near the apex of its cone, just below interior insulator 36, and has its base open. The other insulator shield 48 is securely attached at the base of its cone to wall 2, around the circumference of flange 40, has the apex of its cone open, and surrounds insulator shield 50. Electrode support 16 is at a high potential with respect to wall 2, causing the same potential difference to exist for the insulator shields 48 and 50. Thus a strong electric field is created between insulator shields 48 and 50, which electric field acts to sweep up aerosol particulates charged by the action of corona emitting disk 46, and those already charged before reaching corona emitting disk 46, and thus acts to prevent such charged aerosol particulates from reaching the surface of interior insulator 36. As a further means of preventing moisture buildup on the surfaces of insulators 36 and 38, an electric heating coil 52 is provided, mounted between insulators 36 and 38, which coil heats the interiors of insulators 36 and 38, and thus the bodies of the insulators, so as to keep the surfaces of the insulators above the dew points of the gases to which they are exposed, so that the insulator surfaces will be kept dry.

Although two insulator shields 48 and 50 are used in the preferred embodiment, it would of course be possible to use an array of more than two such shields, for additional sweeping effectiveness and minimizing gas flow toward insulator 36.

Although insulators 36 and 38, and insulator shields 48 and 50, are cone-shaped in the preferred embodiment, it would of course be possible to use other shapes for each of these components, e.g. cylindrical, without departing from the substance of the invention. Similarly, although the insulators 36 and 38 of the preferred embodiment are ceramic, it would of course be possible to instead use insulators of other materials suitable for withstanding the high voltage conditions described above.

Those familiar with the art will appreciate that the invention may be employed in configurations other than the specific configurations disclosed herein, without departing from the substance of the invention. The essential elements of the invention are defined by the following claims.

I claim:

1. In an apparatus for charging aerosol particulates carried in a gas flowing in a chamber having a wall, wherein said gas flows substantially in one direction from a portion of said chamber which is upstream from said apparatus in the flow of said gas, to a portion of said chamber which is downstream from said apparatus in the flow of said gas, wherein the improvement comprises:

(a) main electrode support means, connected to said wall of said chamber, for supporting at least one electrode within said chamber, for electrically connecting a source of direct current high voltage to an electrode supported on said main electrode support means within said chamber, and for maintaining an electrode supported on said main electrode support means within said chamber at a high voltage without flashover from said main electrode support means to said wall of said chamber, and for maintaining an electrode supported on said main electrode support means within said chamber in a mechanically stable configuration;

(b) A first portion of said chamber, wherein said gas flow is mechanically constricted, having a downstream end, and having an outlet at said downstream end, for said gas to exit said first portion of said chamber in a stream passing through said outlet;

(c) A second portion of said chamber, immediately downstream in the flow of said gas from said first portion, having a much larger cross sectional area than the cross sectional area of said first portion of said chamber; and (d) A corona electrode means, connected to said main electrode support means, said main electrode support means located entirely downstream of said first portion and said entire corona electrode means located in said second portion of said chamber near said outlet of said first portion of said chamber, for creating a corona discharge creating molecular ions in said gas near said corona electrode means, and for concentrating said corona discharge in the main portion of said stream of said gas exiting said outlet, and for creating an electric field having field lines diverging from said corona electrode means to the portion of said wall of said chamber surrounding said outlet, and for creating said electric field with a polarity such as to move said molecular ions away from said corona electrode means initially against the direction of said flow of said gas, in the direction of said outlet and said portion of said wall surrounding said outlet.

2. Apparatus of claim 1, wherein said first and second portions of said chamber are cylindrical in form, and wherein said second portion has a much larger inside diameter than said first portion.

3. Apparatus of claim 2, further comprising a solid cylindrical insert mounted within said first portion of said chamber, having a diameter smaller than but close to the inside diameter of said first portion of said chamber, and ending essentially at said outlet of said first portion of said chamber.

4. Apparatus of claim 3, wherein said corona electrode means comprises a band electrode curved into the form of a short circular cylinder, with cylindrical axis lying essentially upon the cylindrical axis of said first portion of said chamber, said short circular cylinder having a diameter which is essentially midway between said diameter of said insert and the inside diameter of said first portion of said chamber, said band electrode having a sharp edge facing toward said outlet of said first portion of said chamber.

5. Apparatus of claim 4, wherein said band electrode is connected to said main electrode support means by spider support comprising a plurality of legs of electrically conductive material extending outward from an electrically conductive hub attached to said main electrode support means, said legs also having a curvature in a direction perpendicular to said main electrode support means, and in the direction of said outlet of said first portion of said chamber.

6. Apparatus of claim 2, wherein said corona emission means comprises a plurality of band electrodes curved into the form of short circular cylinders, said short circular cylinders having cylindrical axes each lying essentially upon said cylindrical axis of said first portion of said chamber, said short circular cylinders having varying diameters extending up to essentially the diameter of said outlet of said first portion of said chamber, said band electrodes having varying widths defining the heights of said short circular cylinders which are progressively greater for progressively smaller diameter short circular cylinders.

7. Apparatus of claim 6, wherein said band electrodes are connected to said main electrode support means by a spider support comprising a plurality of legs of electrically conductive material extending outward from an electrically conductive hub attached to said main electrode support means, said legs also having a curvature in a direction perpendicular to said main electrode support means, and in the direction of said outlet of said first portion of said chamber.

8. Apparatus of any of the preceding claims, wherein said main electrode support means comprises:

(a) A rod of conductive material, essentially perpendicular to said wall of said chamber;

(b) Two high voltage insulators surrounding said rod in a snug fit engagement, an exterior insulator located outside of said chamber and an interior insulator located inside of said chamber;

(c) Passage flange means, in said wall of said chamber, for allowing passage of said rod through said wall;

(d) Compression clamping means, connected to said rod, to said insulators, and to said passage flange means, for compression clamping said insulators firmly against said passage flange means, and for thereby holding said rod securely attached to said passage flange means;

(e) Heating means, in thermal contact with said insulators, for heating said insulators to a temperature above the dew points of any gases to which said insulators are exposed;

(f) Ionization means connected to said rod within said chamber near said interior insulator, for ionizing aerosol particulates moving toward said interior insulator; and (g) Electrostatic precipitation means, connected to said rod between said ionization means and said interior insulator, for electrostatically sweeping up and removing charged aerosol particulates from said gas before said aerosol particulates reach the surface of said interior insulator.

9. Apparatus of claim 8, wherein said heating means comprises an electric resistance heating coil located between said insulators.

10. Apparatus of claim 8, wherein said ionization means comprises a thin sharp-edged corona disc attached to said rod within said chamber, near said interior insulator.

11. Apparatus of claim 8, wherein said electrostatic precipitation means comprises a first electrically conductive insulator shield, surrounding said interior insulator and said rod, having one end of said first insulator shield connected to said wall of said chamber around the circumference of said passage flange means, and having the other end of said first insulator shield open for passage therethrough of said rod, without contacting said rod; and a second electrically conductive insulator shield, within said first insulator shield, attached to and surrounding said rod near one end of said second insulator shield, and being open at the other end of said second insulator shield.

12. Apparatus of claim 8, wherein said high voltage insulators are cone-shaped ceramic insulators oriented in opposing configurations, with the base of each of said insulators being adjacent to said wall of said chamber.

13. Electrode support apparatus, for supporting an electrode within a chamber having a wall and containing a gas containing aerosol particulates, comprising:

(a) A rod of conductive material, essentially perpendicular to said wall of said chamber;

(b) Two high voltage insulators surrounding said rod in a snug fit engagement, an exterior insulator located outside of said chamber and an interior insulator located inside of said chamber;

(c) Passage flange means, in said wall of said chamber, for allowing passage of said rod through said wall;

(d) Compression clamping means, connected to said rod, to said insulators, and to said passage flange means, for compression clamping said insulators firmly against said passage flange means, and for thereby holding said rod securely attached to said passage flange means;

(e) Heating means, in thermal contact with said insulators, for heating said insulators to a temperature above the dew points of any gases to which said insulators are exposed;

(f) Ionization means connected to said rod within said chamber near said interior insulator, for ionizing aerosol particulates moving toward said interior insulator; and (g) Electrostatic precipitation means, connected to said rod between said ionization means and said interior insulator, for electrostatically sweeping up and removing charged aerosol particulates from said gas before said aerosol particulates reach the surface of said interior insulator said electrostatic precipitation means comprising a first electrically conductive insulator shield and a second electrically conductive insulator shield within said first shield and both said first and second shields surrounding said rod.

14. Apparatus of claim 13, wherein said high voltage insulators are cone-shaped ceramic insulators oriented in opposing configurations, with the base of each of said insulators being adjacent to said wall of said chamber.

15. Apparatus of claim 13, wherein said electrostatic precipitation means comprises a first electrically conductive insulator shield, surrounding said interior insulator and said rod, having one end of said first insulator shield connected to said wall of said chamber around the circumference of said passage flange means, and having the other end of said first insulator shield open for passage therethrough of said rod, without contacting said rod; and a second electrically conductive insulator shield, within said first insulator shield, attached to and surrounding said rod near one end of said second insulator shield, and being open at the other end of said second insulator shield.

* * * * *